US008200137B2

(12) United States Patent
Foster et al.

(10) Patent No.: US 8,200,137 B2
(45) Date of Patent: Jun. 12, 2012

(54) FUSER ASSEMBLY INCLUDING A SINGLE BIASING MEMBER

(75) Inventors: Larry Steven Foster, Lexington, KY (US); David Erwin Rennick, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 215 days.

(21) Appl. No.: 12/651,240

(22) Filed: Dec. 31, 2009

(65) Prior Publication Data

US 2011/0158714 A1 Jun. 30, 2011

(51) Int. Cl.
*G03G 15/20* (2006.01)

(52) U.S. Cl. ..... 399/329; 399/122; 399/328

(58) Field of Classification Search ..... 399/329, 399/328, 122

See application file for complete search history.

(56) References Cited

U.S. PATENT DOCUMENTS

| | | | | |
|---|---|---|---|---|
| 6,253,046 | B1 * | 6/2001 | Horrall et al. | 399/122 X |
| 6,671,488 | B2 * | 12/2003 | Izawa et al. | 399/329 |
| 2005/0147434 | A1 * | 7/2005 | Tokuzaki | 399/328 |
| 2008/0170894 | A1 * | 7/2008 | Ishida et al. | 399/329 |
| 2009/0232549 | A1 * | 9/2009 | Foster et al. | 399/122 |

* cited by examiner

*Primary Examiner* — Sophia S Chen

(57) ABSTRACT

A fuser assembly includes a translatable heater member and a rotatable backup member mounted against the translatable heater member. The translatable heater member includes a heater housing extending through end frames disposed at the ends of the fuser assembly. A biasing member is positioned adjacent and parallel to the translatable heater member. A support structure is positioned at each end of the biasing member for supporting the biasing member. The support structure includes bell crank members that are engaged with the ends of the biasing member. The biasing member applies force on the heater housing through the bell crank members to bias the translatable heater member against the rotatable backup member.

20 Claims, 7 Drawing Sheets

FUSER ASSEMBLY INCLUDING A SINGLE BIASING MEMBER

BACKGROUND

1. Field of the Invention

The present invention relates generally to a fuser assembly including a rotatable backup member and a translatable heater member and, more particularly to a fuser assembly having a single biasing member for biasing the translatable heater member against the rotatable backup member.

2. Description of the Related Art

An image forming apparatus, such as a color printer typically includes four units associated with four colors, black, magenta, cyan, and yellow. Each unit includes a laser printhead that is used to provide a latent image on the charged surface of a photoconductive unit. The latent image on each photoconductive unit is developed with the appropriate color toner and is then transferred to either an intermediate transfer medium or directly to a media (such as paper) that travels past the photoconductive units.

The un-fused toner on the media is then fused to the media by application of heat and pressure in a fuser assembly. The fuser assembly includes a rotatable backup member and a translatable heater member disposed adjacent the rotatable backup member to form a nip through which the media passes for fusing the toner to the media.

FIG. 1 illustrates a fuser assembly 10 of the image forming apparatus according to a prior system. The fuser assembly 10 includes a rotatable backup member 12 and a translatable heater member 14 disposed adjacent the rotatable backup member 12. End frames 16 are disposed at the ends of the fuser assembly 10, only one of which is shown. The rotatable backup member 12 includes a backup roll 18 and a pivot 20 mounted within the end frames 16 for supporting the backup roll 18. The translatable heater member 14 has a heater housing 22 that extends through the end frames 16. Further, the fuser assembly 10 has a spring 24 positioned on each end frame 16 for loading the rotatable backup member 12 against the translatable heater member 14.

Due to space constraints in the image forming apparatus the spring 24, in the prior system, was relatively short with a high spring rate. The tolerance of this short spring 24 positioned on each end frame 16 accounted for 20% difference in force applied by the spring 24 positioned on end frame 16 disposed at one end of the fuser assembly 10 with respect to the force applied by the spring 24 positioned on end frame 16 disposed at the other end of the fuser assembly 10. This difference in force applied by the spring 24 resulted in an inconsistent and unequal loading of the rotatable backup member 12 against the translatable heater member 14.

Further, using two springs 24 magnifies geometrical differences between the ends of the fuser assembly 10 causing uneven loading of the rotatable backup member 12 against the translatable heater member 14. The uneven loading of the rotatable backup member 12 against the translatable heater member 14 results in several disadvantages such as treeing, worming, tail flip, and light print.

Therefore, it would be advantageous to have a fuser assembly that has the translatable heater member substantially evenly loaded against the rotatable backup member.

SUMMARY OF THE INVENTION

Disclosed herein is a fuser assembly including a rotatable backup member, a translatable heater member positioned adjacent the rotatable backup member, a biasing member positioned adjacent and parallel to the translatable heater member, the biasing member having a first end and a second end, and a support structure positioned at the ends of the biasing member for supporting the biasing member, the biasing member applying a force on at least a portion of the translatable heater member through at least a portion of the support structure in a direction towards the rotatable backup member to bias the translatable heater member against the rotatable backup member.

In some embodiments, a first end frame and a second end frame are disposed on the ends of the fuser assembly with the first end of the biasing member extending through the first end frame and the second end of the biasing member extending through the second end frame. The support structure includes a first bracket member mounted on the first end frame, a second bracket member mounted on the second end frame, a first bell crank member pivotally mounted on the first bracket member, and a second bell crank member pivotally mounted on the second bracket member. Each bell crank member includes a pivot post mounted on the bracket members, an extension at one end of the bell crank member, and a hook portion at other end of the bell crank member, the hook portion having a curved surface that engages an end of the biasing member which applies a force on the hook portion to move the bell crank member such that the extension of the bell crank members applies a force on at least the portion of the second support structure towards the first support structure.

In some embodiments, the translatable heater member includes a heater housing, a heater element located in the heater housing, and a first end cap and a second end cap positioned at the ends of the translatable heater member for supporting the translatable heater member, the first end cap mounted within the first end frame and the second end cap mounted within the second frame. In this way, the bell cranks apply a force on the portion of the heater housing extending through the end frames. This force results in a substantially evenly distributed force on the translatable heater member against the rotatable backup member.

Additional features and advantages of the invention will be set forth in the detailed description which follows, and in part will be readily apparent to those skilled in the art from that description or recognized by practicing the invention as described herein, including the detailed description, which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent will be better understood by reference to the accompanying drawings, wherein.

DETAILED DESCRIPTION

Figure 1:
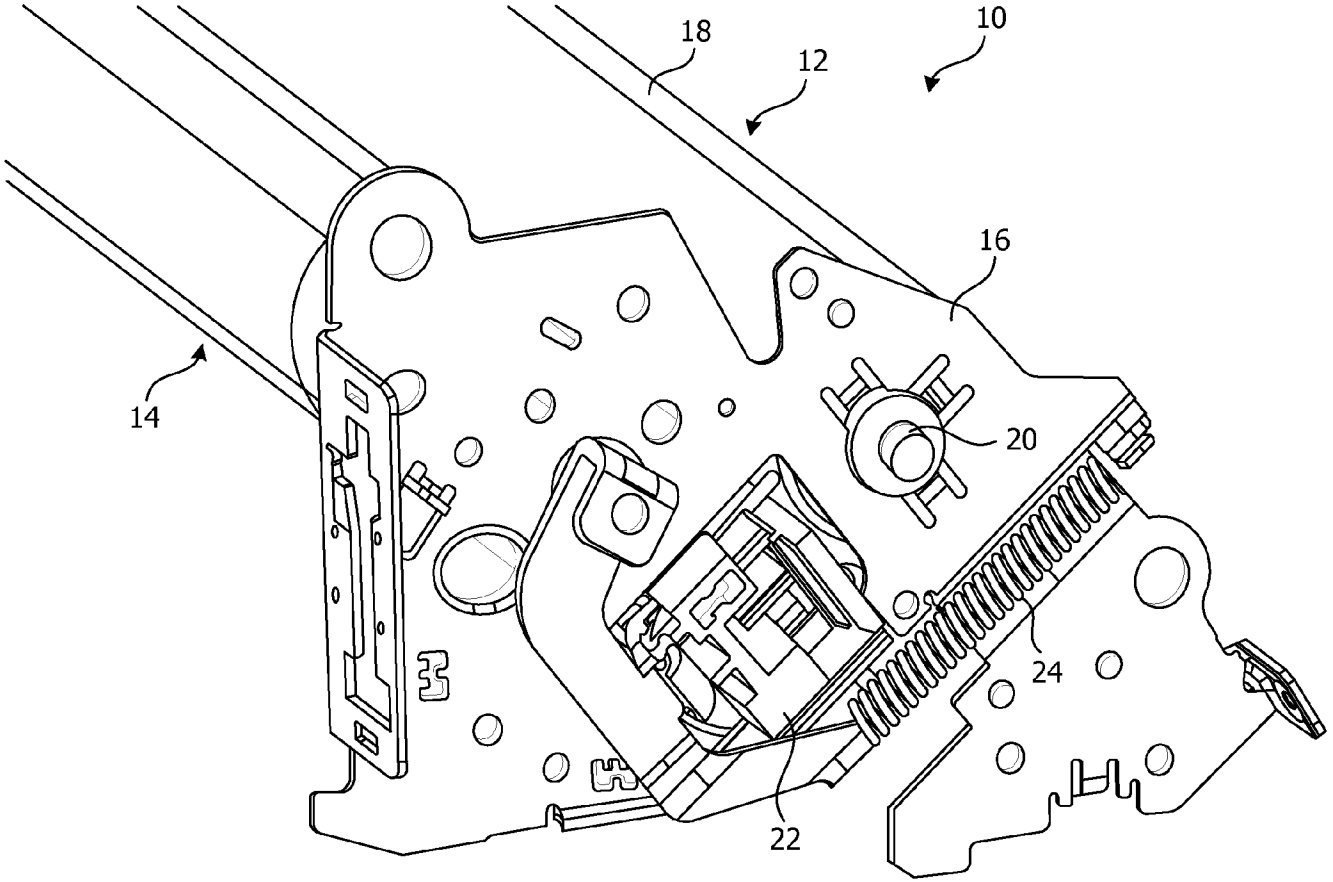
Prior Art FIG. 1
FIG. 1 illustrates a perspective view of a fuser assembly according to a prior system.

It is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof are used broadly and encompass direct and indirect connections, couplings and mountings. In addition, the terms "connected" and "coupled" and variations thereof are not restricted to physical or mechanical connections or couplings.

Reference will now be made in detail to the exemplary embodiment(s) of the invention, as illustrated in the accompanying drawings. Whenever possible, the same reference numerals will be used throughout the drawings to refer to the same or like parts.

Figure 2:
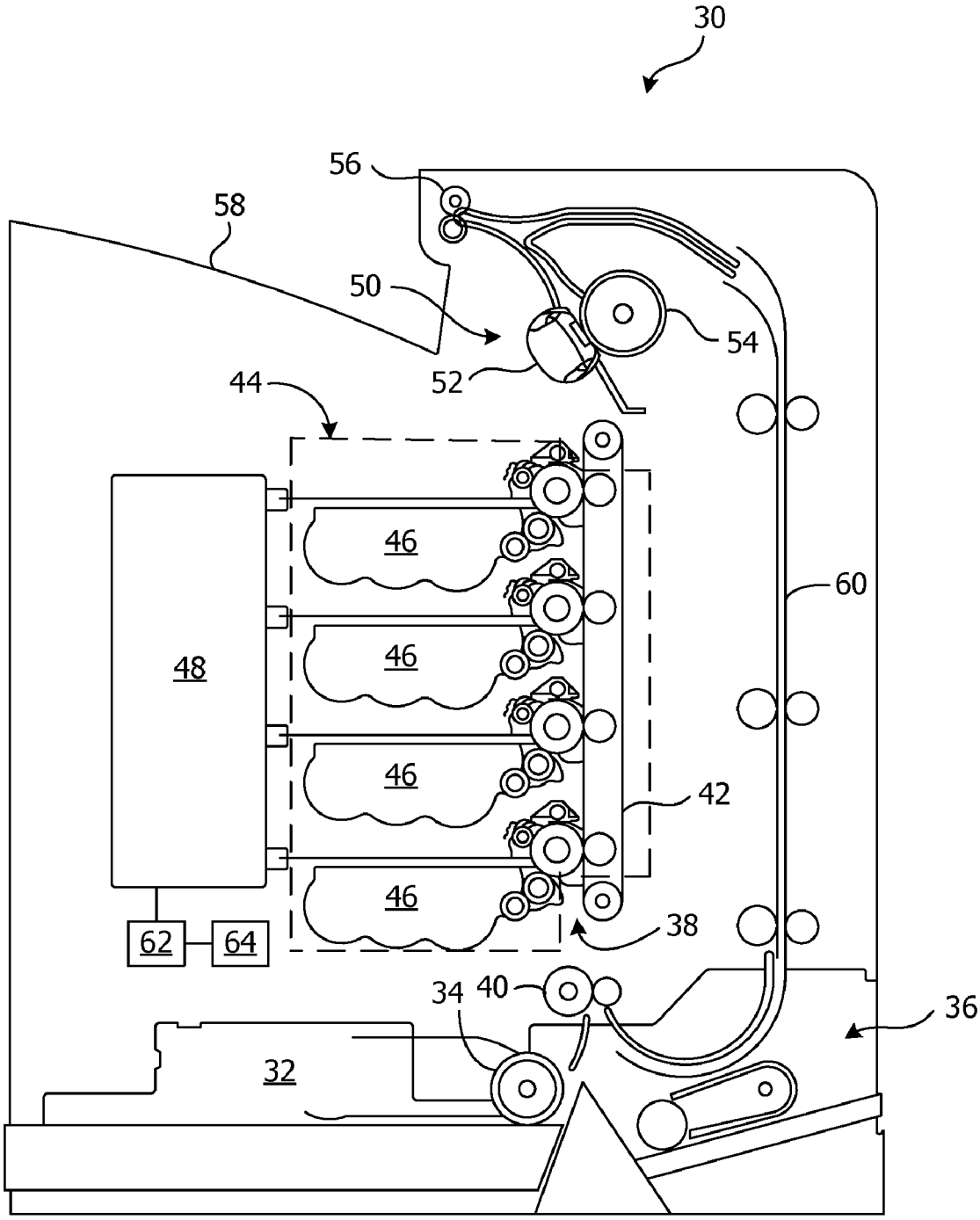
FIG. 2 is a side view of an image forming apparatus containing a fuser assembly according to an exemplary embodiment of the present invention.

FIG. 2 illustrates an image forming apparatus 30 according to the present invention. The image forming apparatus 30 includes a media tray 32 with a pick mechanism 34, or a manual input 36, for introducing media in the image forming apparatus 30. Media from the media tray 32 or the manual input 36 are fed into a primary media path 38. One or more registration rollers 40 are disposed along the primary media path 38 to align media and precisely control its further movement along the primary media path 38. A media transport belt 42 may form a section of the primary media path 38 for moving media past an image transfer assembly 44. The image transfer assembly 44 includes a plurality of image forming units 46.

As illustrated in FIG. 2, the image forming apparatus 30 includes four image forming units 46 for transferring print material on media to produce a full color image. The image forming units 46 are disposed along a vertical plane. The print material typically comprises toner of varying colors. For illustrative purposes, the image forming units 46 include cyan, magenta, yellow, and back toner to produce a full-color image on the media. It is understood that image forming apparatus 30 may include more or less than four image forming units 46.

An imaging device 48 forms an electrical charge on a photoconductive unit within the image forming units 46 as part of the image formation process. Various imaging devices may be used such as a laser printhead or a LED printhead.

Media with un-fused toner from one or more image forming units 46 is then moved by the media transport belt to a fuser assembly 50. The fuser assembly 50 includes a translatable heater member 52 and a rotatable backup member 54. The fuser assembly 50 applies heat and pressure to the media to fuse the un-fused toner to the media. Exit rollers 56 rotate in a forward or reverse direction to move the media with the fused image from the fuser assembly 50 to an output tray 58 or a duplex path 60.

The image forming apparatus 30 also includes a processor 62 and a memory 64. The processor 62 controls the transfer of the toner image on to the media, as well as movement of the media through the media path 38 and the duplex path 60.

Figure 3:
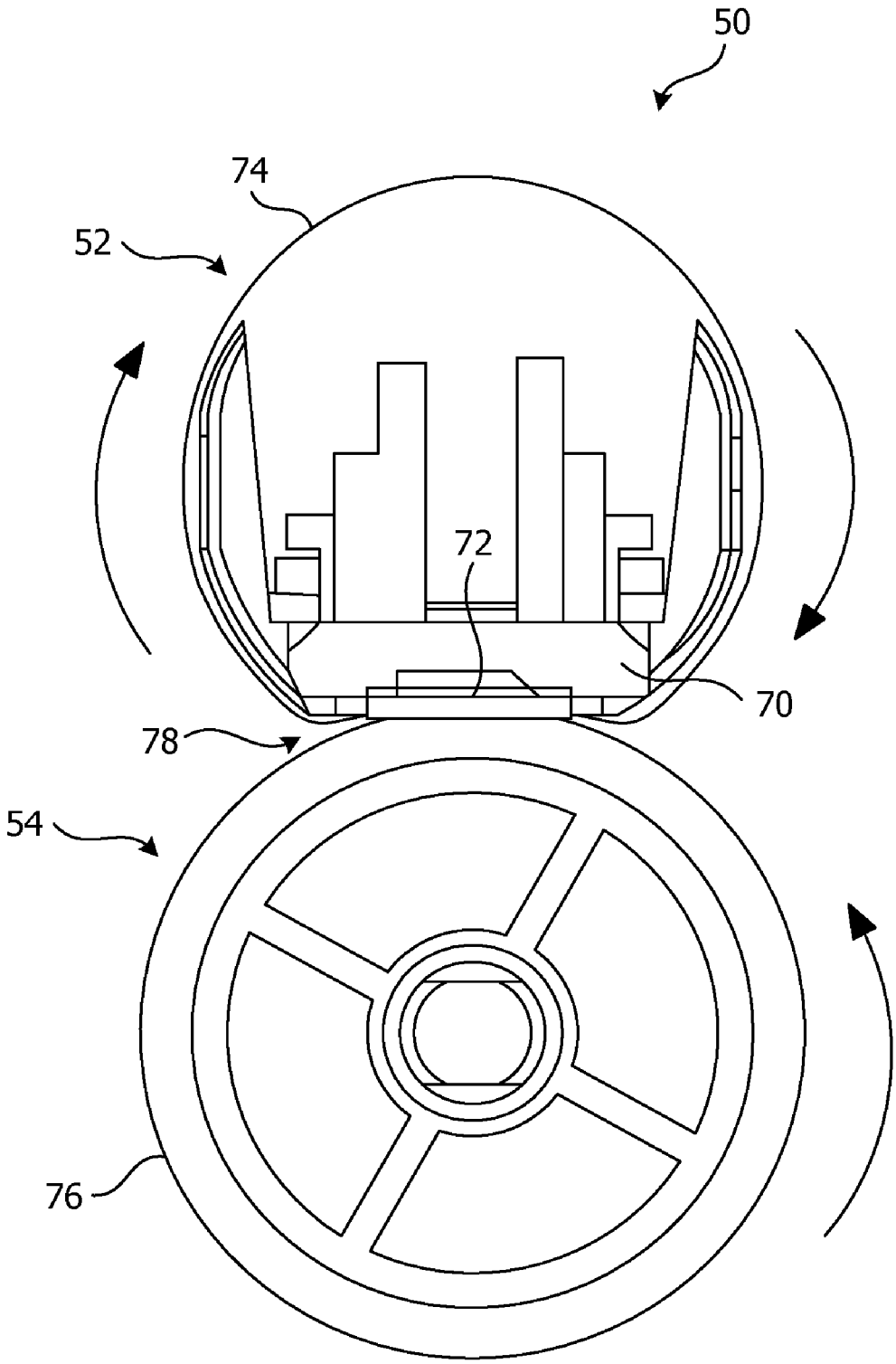
FIG. 3 is a side view of a fuser assembly according to an exemplary embodiment of the present invention.

FIG. 3 illustrates a side view of the fuser assembly 50 according to the present invention. As discussed above, the fuser assembly 50 includes the translatable heater member 52 and the rotatable backup member 54. The translatable heater member 52 includes a heater housing 70 and a heater element 72 located within the heater housing 72. The heater element 72 is capable of providing adequate temperature for fusing toner to the media. The heater element 72 may include, for example, ceramic heating element or heating lamps. The translatable heater member 52 also includes a rotatable heat transfer member 74, such as a flexible belt, rotating about heater housing 70.

The rotatable backup member 54 includes a rotatable backup roll 76 positioned adjacent the translatable heater member 52. Pressure is applied between the translatable heater member 52 and the rotatable backup member 54 to forms a nip 78 through which the media with the un-fused toner is passed. As media enters the nip 78, energy is passed from the heating element 72 through the translatable heat transfer member 74 to the media, such that the un-fused toner on the media is fused to the media due to the applied heat and pressure between the translatable heater member 52 and the rotatable backup member 54.

Figure 4:
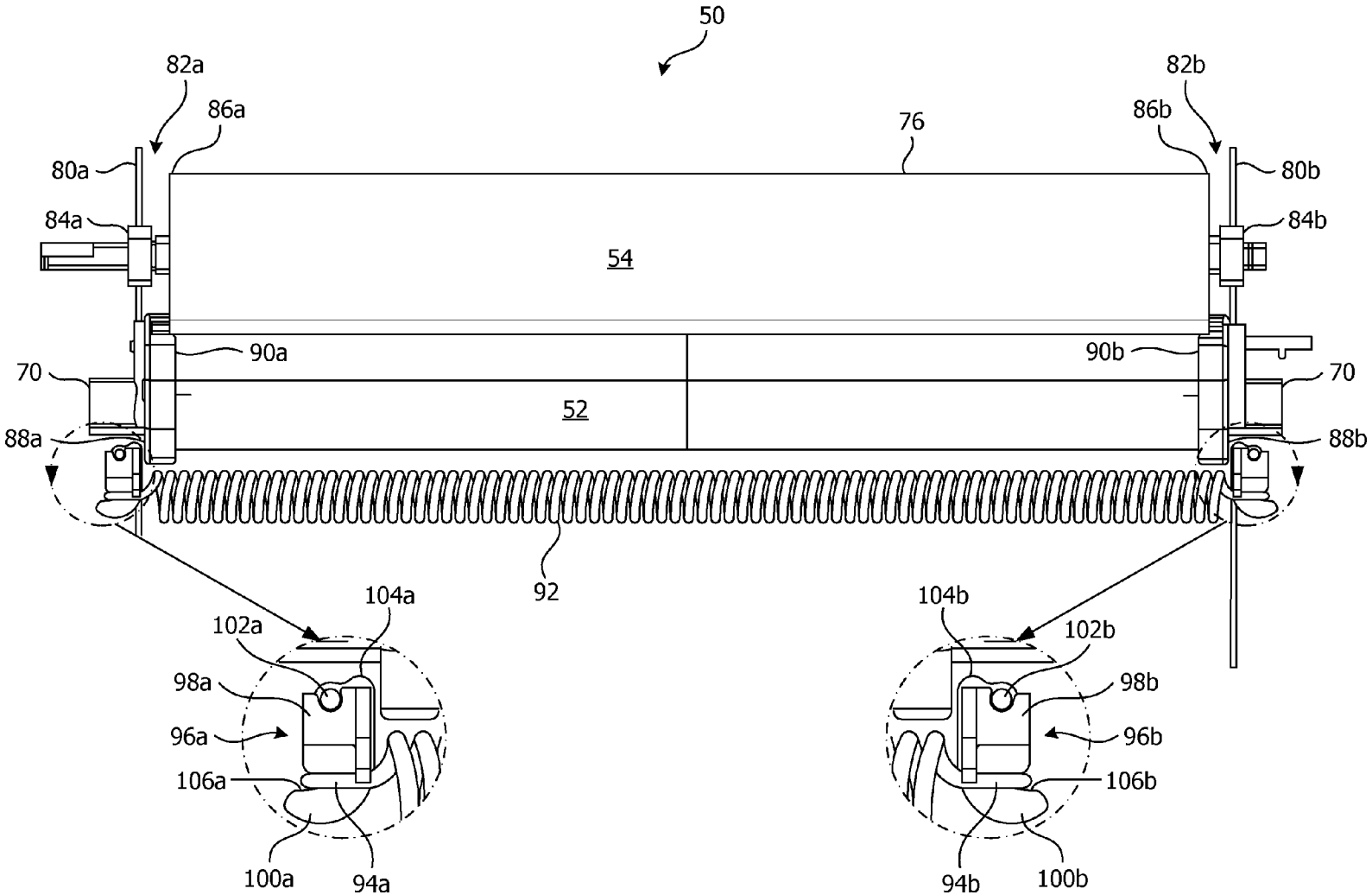
FIG. 4 is a front view of a fuser assembly including a biasing member and a support structure according to an exemplary embodiment of the present invention.
Figure 5:
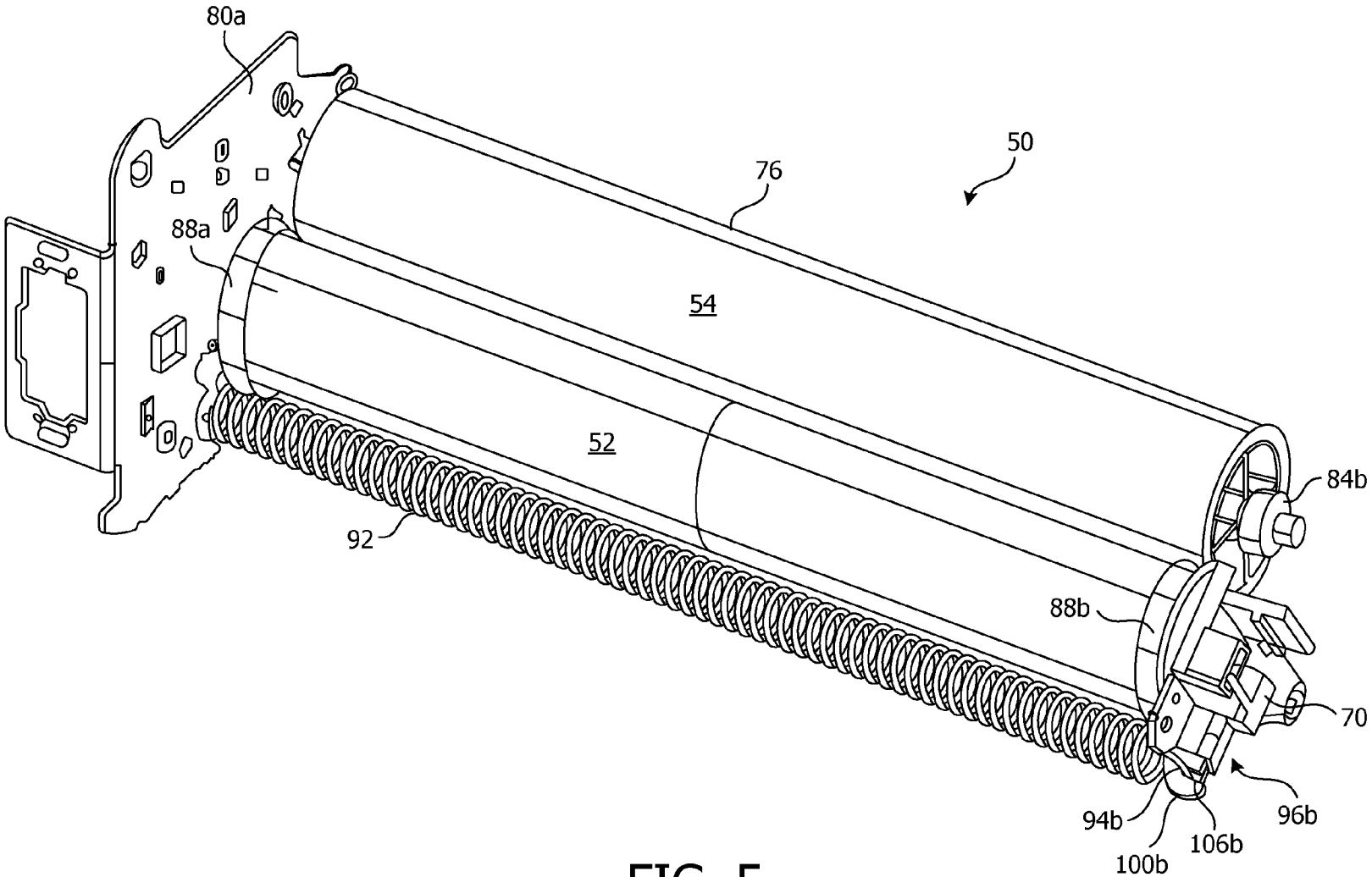
FIG. 5 is a perspective view of the fuser assembly of FIG. 4.

FIGS. 4 and 5 are front elevational and perspective views of the fuser assembly 50 that has the rotatable backup member 54 biased against the translatable heater member 52 according to one embodiment of the present invention. A first end frame 80*a* and a second end frame 80*b* are disposed on the ends 82*a* and 82*b* of the fuser assembly 50. The rotatable backup member 54 includes the backup roll 76 and a pair of bearings 84*a* and 84*b* positioned at the ends 86*a* and 86*b* respectively, of the backup roll 76. The bearing 84*a* is mounted within the first end frame 80*a* and the bearing 84*b* is mounted within the second end frame 80*b*, for supporting the backup roll 76. The bearings 84*a* and 84*b* are free to rotate within the end frames 80*a* and 80*b*, respectively.

The translatable heater member 52 includes a first end cap 88*a* positioned at end 90*a* of the translatable heater member 52 and a second end cap 88*b* positioned at end 90*b* of the translatable heater member 52. As shown in FIG. 5, the first end cap 88*a* is mounted within the first end frame 80*a* and is free to translate within the first end frame 80*a*. Similarly, the second end cap 88*b* is mounted within the second end frame 80*b* and is free to translate within the second end frame 80*b*. A portion of the heater housing 70 extends through the end frames 80*a* and 80*b*. The portion of the heater housing 70 extending through the end frames 80*a* and 80*b* are adjacent the pair of bearings 84*a* and 84*b* of the rotatable backup member 54.

The fuser assembly 50 further includes a biasing member 92 positioned adjacent and parallel to the translatable heater member 52. The biasing member 92 has a first end 94*a* extending through the first end frame 80*a* and a second end 94*b* extending through the second end frame 80*b*. The biasing member 92 in the present embodiment is an extension spring.

The fuser assembly 50 includes support structure 96*a* and 96*b* to which the ends 94*a* and 94*b* of the biasing member 92 are coupled. With reference to FIG. 4, the support structure 96*a* includes a first bracket member 98*a* mounted on the first end frame 80*a*. The support structure 96*b* includes a second bracket member 98*b* mounted on the second end frame 80*b*.

The support structure 96*a* further includes a first bell crank member 100*a* and the support structure 96*b* further includes a second bell crank member 100*b*. The first bell crank member 100*a* includes a pivot post 102*a* for pivotally mounting the first bell crank member 100*a* on the first bracket member 98*a*. The first bell crank member 100*a* is free to rotate around the pivot post 102*a* of the first bell crank member 100*a*. The second bell crank member 100*b* includes a pivot post 102*b* for pivotally mounting the second bell crank member 100*b* on the second bracket member 98*b*. The second bell crank member 100*b* is free to rotate around the pivot post 102*b* of the second bell crank member 100*b*.

The first bell crank member 100*a* and the second bell crank member 100*b* include extensions 104*a* and 104*b*, respectively, positioned adjacent the portion of the heater housing 70 extending through the end frames 80*a* and 80*b*. The first bell crank member 100*a* has a hook portion 106*a* and the second bell crank member 100*b* has a hook portion 106*b*. Hook portion 106*a* is positioned on the opposite side of pivot post 102*a* from extension 104*a*, and hook 106*b* is positioned on the opposite side of pivot post 102*b* from extension 104*b*. As shown in FIG. 5, the hook portions 106*a* and 106*b* have a curved surface that engages the first end 94*a* and the second end 94*b* respectively, of the biasing member 92.

Figure 6:
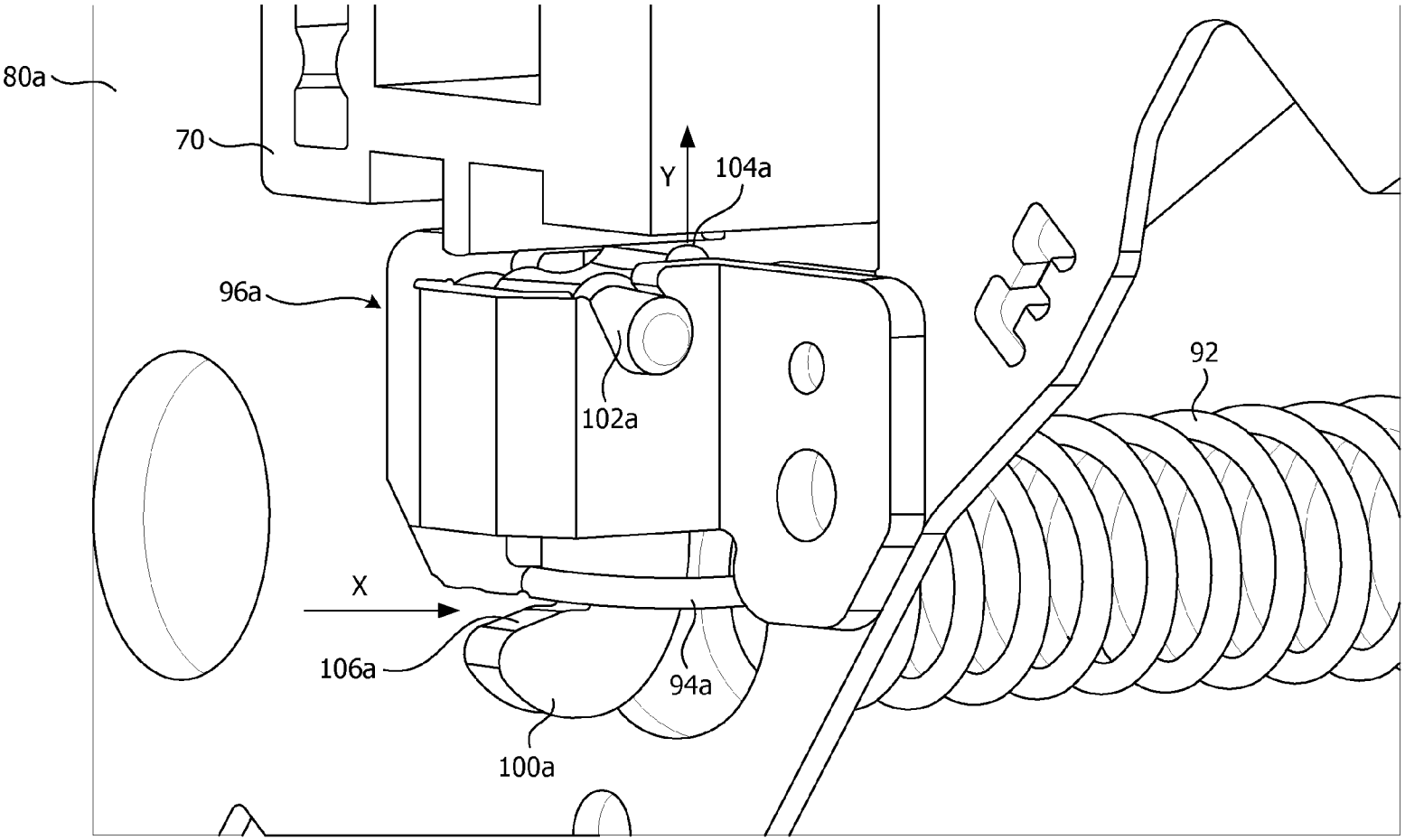
FIG. 6 illustrates a detailed perspective view of a portion of the fuser assembly of FIGS. 4 and 5 showing biasing forces being applied to a translatable heater member.

FIG. 6 illustrates a detailed perspective view of the forces being applied due to biasing the rotatable backup member 54 against the translatable heater member 52 of FIGS. 4 and 5.

As shown, the first end 94*a* of the biasing member 92 is engaged with the hook portion 106*a* which pulls the first bell crank member 100*a* in a generally horizontal direction X towards the biasing member 92 and bell crank 100*b*. This bias force causes the first bell crank member 100*a* to pivot about the pivot post 102*a* in a generally counter-clockwise direction such that the extension 104*a* of the first bell crank member 100*a* is displaced in a generally upward direction Y which pushes the portion of the heater housing 70 extending through the first end frame 80*a* generally upwardly towards the bearing 84*a* mounted within the first end frame 80*a*.

Similarly, the second end 94*b* of the biasing member 92 similarly pulls the second bell crank member 100*b* to pivot the second bell crank member 100*b* in a clockwise direction about pivot post 102*b*. The extension 104*b* of the second bell crank member 100*b* moves generally upwardly which pushes the portion of the heater housing 70 extending through the second end frame 80*b* towards the bearing 84*b* mounted within the second end frame 80*b*.

The upward force applied by the extensions 104*a* and 104*b* of the bell crank members 100*a* and 100*b* on the heater housing 70 biases the translatable heater member 52 against the rotatable backup member 54 such that a substantially constant and uniform pressure is applied between the translatable heater member 52 and the rotatable backup member 54.

As a single biasing member 92 is used for loading both ends 82*a* and 82*b* of the fuser assembly 50, a substantially consistent and substantially equal load is applied across fuser assembly 50. Further, as there are less space constraints along the length of the fuser assembly 50 than along its lateral dimension, a much longer biasing member 92 is used in the present invention, resulting in a lower spring rate. The lower spring rate reduces the effects of geometric differences between the ends 82*a* and 82*b* of the fuser assembly 50. Using a single biasing member 92 also eliminates the shortcoming of having different spring tolerances from two springs that result in uneven loading of the fuser assembly of prior systems, like the fuser assembly of FIG. 1.

Additionally, with the single biasing member 92 the pressure between the translatable heater member 52 and the rotatable backup member 54 can be changed with a single adjustment of the biasing member 92 without changing the relationship between forces applied by the biasing member 92 to the support structure 96*a* and support structure 96*b*.

Figure 7:
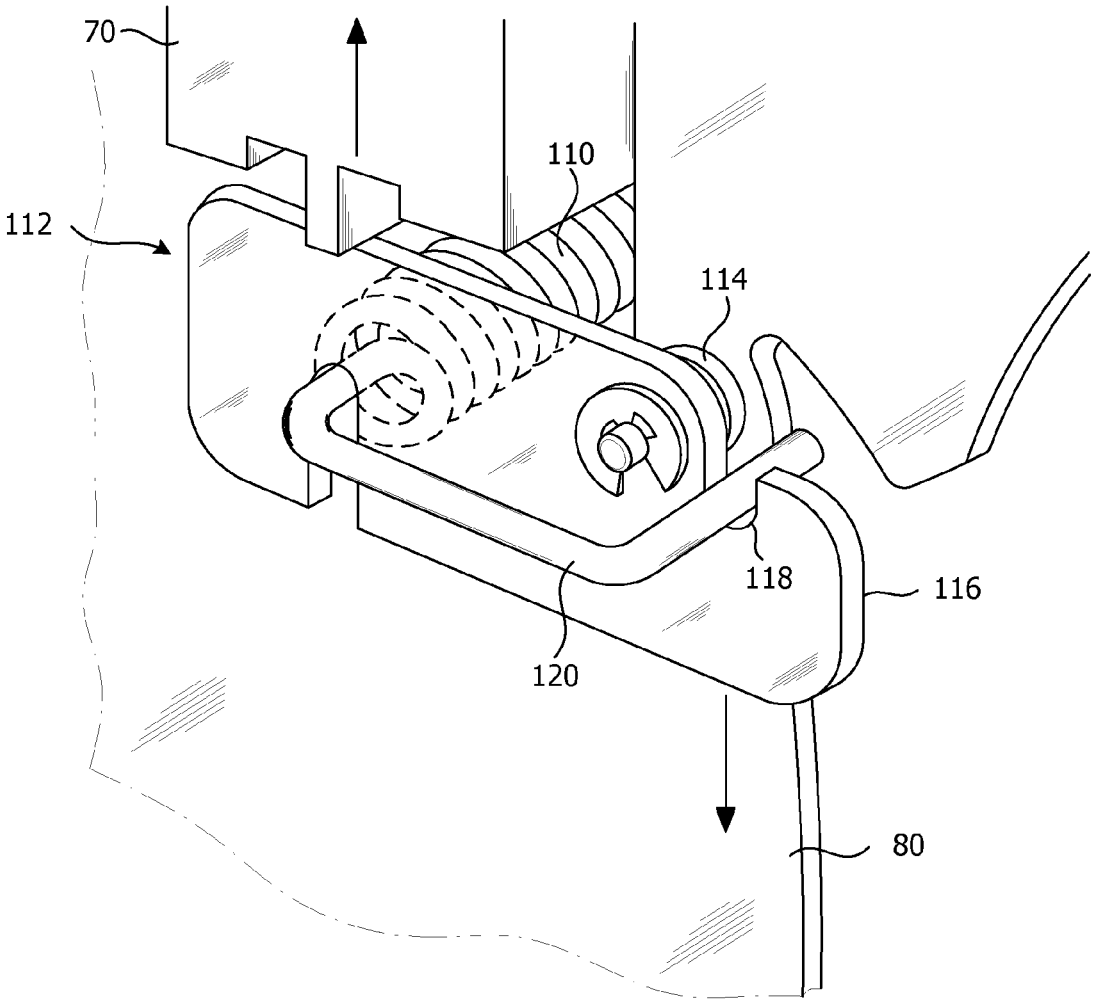
FIG. 7 is a side perspective view of a biasing member and a support structure according to another embodiment of the present invention.

FIG. 7 illustrates a biasing member 110 and support structures 112 according to another embodiment of the present invention. The biasing member 110 is a torsion spring. The support structure 112, located at each end frame 80*a*, 80*b* of fuser assembly 50, includes a bell crank pivot post 114 positioned on corresponding end frame 80. Bell crank member 116 is pivotally mounted on the bell crank pivot post 114 such that the pivot axis of the bell crank pivot post 114 is substantially perpendicular to the corresponding end frame 80. The bell crank member 116 has a hook portion 118 that engages an end 120 of the biasing member 110.

As shown in FIG. 7, the end 120 of the biasing member 110 applies a generally downward force on the bell crank member 116 to pivot the bell crank member 116 in a clockwise direction (when viewed from outside of each end frame 80) such that the bell crank member 116 pushes the corresponding end portion of the heater housing 70 extending through the end frame 80 generally upwardly towards the bearing 84*a* mounted within the end frame 80 (see FIG. 4).

This force applied by the bell crank members 116 to the portion of heater housing 70 extending through the end frames 80, towards the pivots 84*a* and 84*b* mounted within the end frames 80 biases the translatable heater member 52 against the rotatable backup member 54 such that a substantially constant pressure is applied between the translatable heater member 52 and the rotatable backup member 54. As a single biasing member 110 is used for loading both ends 82 of the end frames 80 a substantially consistent load is applied along the fuser assembly 50.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A fuser assembly comprising:

a rotatable backup member;

a heater member positioned adjacent the rotatable backup member;

a biasing member positioned substantially parallel to the heater member and the rotatable backup member, the biasing member having a first end and a second end, the biasing member comprising a spring; and a support structure positioned at the ends of the biasing member for supporting the biasing member, the biasing member applying force on at least a portion of one of the heater member and the rotatable backup member through at least a portion of the support structure towards the other of the heater member and the rotatable backup member to form a fuser nip between the heater member and the rotatable backup member, the one of the rotatable backup member and the heater member being translatable.

2. The fuser assembly of claim 1, wherein the spring is a tension spring.

3. The fuser assembly of claim 1, wherein the spring is a torsion spring.

4. The fuser assembly of claim 1, further comprising:

a first end frame and a second end frame disposed on the ends of the fuser assembly, the first end of the biasing member extending through the first end frame and the second end of the biasing member extending through the second end frame, wherein the support structure comprises:

a first bell crank member pivotally coupled to the first end frame; and a second bell crank member pivotally coupled to the second end frame, each bell crank member comprising:

a pivot post coupled to a corresponding end frame;

an extension at one end of the bell crank member; and a first portion at a second end of the bell crank member substantially opposite the extension, the first portion having a surface that engages one of the ends of the biasing member, the biasing member applying force on the first portion to move the bell crank member such that the extension of the bell crank member applies force on at least the portion of the one of the heater member and rotatable backup member.

5. The fuser assembly of claim 1, wherein the heater member is translatable relative to the rotatable backup member.

6. The fuser assembly of claim 1, wherein the spring provides a substantially uniform force along the one of the heater member and the rotatable backup member.

7. A fuser assembly, comprising:

a rotatable backup member;

a translatable heater member positioned adjacent the rotatable backup member;

a biasing member positioned adjacent and substantially parallel to the translatable heater member, the biasing member having a first end and a second end;

a support structure positioned at the ends of the biasing member for supporting the biasing member, the biasing member applying a force on at least a portion of the translatable heater member through at least a portion of the support structure towards the rotatable backup member to bias the translatable heater member against the rotatable backup member; and a first end frame and a second end frame disposed on the ends of the fuser assembly, the first end of the biasing member extending through the first end frame and the second end of the biasing member extending through the second end frame, wherein the support structure comprises:

a first bracket member mounted on the first end frame;

a second bracket member mounted on the second end frame;

a first bell crank member pivotally mounted on the first bracket member; and a second bell crank member pivotally mounted on the second bracket member, each bell crank member comprising:

a pivot post mounted on a corresponding bracket member;

an extension at one end of the bell crank member; and a hook portion at other end of the bell crank member, the hook portion having a curved surface that engages a corresponding end of the biasing member, the biasing member applying force on the hook portion to move the bell crank member such that the extension of the bell crank members applies force on at least the portion of the translatable heater member towards the rotatable backup member.

8. The fuser assembly of claim 7, wherein the biasing member applies equal force on the hook portion of the first bell crank member and the second bell crank member.

9. The fuser assembly of claim 7, wherein the translatable heater member comprises:

a heater housing;

a heater element located in the heater housing; and a first end cap and a second end cap positioned at the ends of the translatable heater member for supporting the translatable heater member, the first end cap mounted within the first end frame and the second end cap mounted within the second end frame, wherein a portion of the heater housing extends through the end frames, the bell crank members applying force on the portion of the heater housing extending through the end frames.

10. The fuser assembly of claim 7, wherein the rotatable backup member comprises:

a backup roll; and a pair of bearings positioned at each end of the backup roll, the pair of bearings mounted within the end frames for supporting the backup roll.

11. A fuser assembly comprising:

a rotatable backup member including a backup roll;

a heater member positioned adjacent the rotatable backup member, the heater member including a heater housing, and a heater element located in the heater housing, at least one of the rotatable backup member and the heater member being translatable;

a single biasing member positioned adjacent the at least one of the rotatable backup member and the heater member; and a support structure coupled to the single biasing member and the at least one of the rotatable backup member and the heater member for applying a biasing force from the single biasing member thereto in a direction towards the other of the rotatable backup member and the heater member so as to form a fusing nip therebetween, the single biasing member being an undriven biasing member which provides a substantially uniform force along the one of the heater member and the rotatable backup member.

12. The fuser assembly of claim 11, wherein the single biasing member is a tension spring.

13. The fuser assembly of claim 11, wherein the single biasing member is an extension spring.

14. The fuser assembly of claim 11, wherein the single biasing member is disposed in substantially parallel relation with the heater member.

15. The fuser assembly of claim 11, wherein the single biasing member comprises a spring.

16. The fuser assembly of claim 11, wherein the heater member is translatable relative to the rotatable backup member.

17. A fuser assembly comprising:

a rotatable backup member including a backup roll;

a translatable heater member positioned adjacent the rotatable backup member, the translatable heater member including a heater housing, and a heater element located in the heater housing;

a single biasing member positioned adjacent the translatable heater member;

a support structure coupled to the single biasing member and the translatable heater member for applying a biasing force from the single biasing member to the translatable heater member in a direction towards the rotatable backup member; and a first end frame and a second end frame disposed on ends of the fuser assembly, the single biasing member having a first end extending through the first end frame and a second end extending through the second end frame;

wherein the support structure is disposed at ends of the single biasing member, the support structure comprising:

a first bracket member mounted on the first end frame and a second bracket member mounted on the second end frame; and a first bell crank member and a second bell crank member, the bell crank members each including a pivot post mounted on a corresponding one of the bracket members, an extension at one end of the bell crank member, and a hook portion at the other end of the bell crank member.

18. The fuser assembly of claim 17, wherein the rotatable backup member includes a pair of bearings supporting the backup roll, a portion of the heater housing extends through the end frames, the bearings of the rotatable backup member are mounted within the end frames adjacent the portion of the heater housing extending through the end frames, and the bell crank members are positioned adjacent the portion of the heater housing extending through the end frames.

19. The fuser assembly of claim 18, wherein each hook portion of the bell crank members has a curved surface that engages a corresponding end of the single biasing member, the single biasing member applying force on the hook portions that moves the bell crank members such that the extensions of the bell crank members apply a force on the portion of the heater housing extending through the end frames towards the bearings to maintain a substantially constant pressure between the rotatable backup member and the heater member.

20. The fuser assembly of claim 17, wherein the single biasing member applies a substantially equal force on the hook portions of the first bell crank member and the second bell crank member.

* * * * *